US010544556B2

(12) United States Patent
Amin et al.

(10) Patent No.: US 10,544,556 B2
(45) **Date of Patent: *Jan. 28, 2020**

(54) SNOW REMOVAL TRUCK BROOM SYSTEMS AND METHODS

(71) Applicant: Oshkosh Corporation, Oshkosh, WI (US)

(72) Inventors: Bashar M. Amin, Oshkosh, WI (US); Mitch F. Sears, Ripon, WI (US); Ben G. Lochner, Neenah, WI (US); Jason M. Ollanketo, Oshkosh, WI (US); Jason R. Shively, Oshkosh, WI (US); Sean Strosahl, Oshkosh, WI (US); Kellie Watters, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 407 days.

This patent is subject to a terminal disclaimer.

(21) Appl. No.: 15/346,648

(22) Filed: Nov. 8, 2016

(65) Prior Publication Data

US 2017/0051462 A1 Feb. 23, 2017

Related U.S. Application Data

(63) Continuation of application No. 14/213,558, filed on Mar. 14, 2014, now Pat. No. 9,493,921.
(Continued)

(51) Int. Cl.
*E01H 1/05* (2006.01)
*E01H 5/09* (2006.01)

(52) U.S. Cl.
CPC ..... *E01H 1/056* (2013.01); *E01H 5/092* (2013.01)

(58) Field of Classification Search
CPC .. E01H 1/02; E01H 1/05; E01H 1/056; E01H 5/08; E01H 5/09; E01H 5/092
(Continued)

(56) References Cited

U.S. PATENT DOCUMENTS 2,278,306 A 3/1942 Cushman
3,037,226 A 6/1962 Schmidt et al.
(Continued)

FOREIGN PATENT DOCUMENTS

DE 3740215 * 6/1988
DE 38 41 178 6/1990
JP 10-317340 12/1998

OTHER PUBLICATIONS

U.S. Appl. No. 14/088,177, filed Nov. 22, 2013, Oshkosh Corporation.
(Continued)

*Primary Examiner* — Mark Spisich
(74) *Attorney, Agent, or Firm* — Foley & Lardner LLP

(57) ABSTRACT

A broom assembly for a vehicle includes a frame, a broom core axle rotatably coupled to the frame and defining an axis around which a broom rotates, an actuator coupled to the frame and positioned to raise and lower the axle relative to the frame, and a controller. The controller has an output for adjusting the actuator and an input for receiving information from a sensor. To account for the estimated wear, the controller is configured to use the received information to automatically lower the axle over a period of operation and use the sensor input to controllably adjust the actuator to a position setpoint changing over the period of operation. After operation, the controller is configured to use the sensor input to determine a current position, add an offset to the current position to achieve a new sensor target setpoint, and use the new setpoint to adjust the output.

15 Claims, 16 Drawing Sheets

Related U.S. Application Data

(60) Provisional application No. 61/799,358, filed on Mar. 15, 2013.

(58) Field of Classification Search
USPC ..... 15/82
See application file for complete search history.

(56) References Cited

U.S. PATENT DOCUMENTS

| | | | |
|---|---|---|---|
| 4,760,657 | A | 8/1988 | Ganzmann et al. |
| 5,015,300 | A | 5/1991 | Leers |
| 6,678,912 | B1 | 1/2004 | Ruuska et al. |
| 6,681,433 | B1 | 1/2004 | Ruuska et al. |
| 6,918,481 | B2 | 7/2005 | Quigley et al. |
| 6,938,749 | B1 | 9/2005 | Quigley et al. |
| D562,200 | S | 2/2008 | Lackore et al. |
| D572,642 | S | 7/2008 | Steckling et al. |
| D617,242 | S | 6/2010 | Lackore et al. |
| 8,465,025 | B2 | 6/2013 | Venton-Walters et al. |
| 8,764,029 | B2 | 7/2014 | Venton-Walters et al. |
| 8,991,834 | B2 | 3/2015 | Venton-Walters et al. |
| 9,008,913 | B1 | 4/2015 | Sears et al. |
| 9,315,210 | B2 | 4/2016 | Sears et al. |
| 2003/0074753 | A1 | 4/2003 | Hansen |
| 2004/0045581 | A1 | 3/2004 | Boomgaarden et al. |

OTHER PUBLICATIONS

U.S. Appl. No. 29/249,496, filed Oct. 9, 2006, Oshkosh Corporation.

U.S. Appl. No. 29/249,497, filed Oct. 9, 2006, Oshkosh Corporation.

* cited by examiner

SNOW REMOVAL TRUCK BROOM SYSTEMS AND METHODS

CROSS-REFERENCE TO RELATED PATENT APPLICATION

This is a continuation of U.S. patent application Ser. No. 14/213,558, filed Mar. 14, 2014, now U.S. Pat. No. 9,493,921, which claims the benefit of U.S. Provisional Application No. 61/799,358, filed Mar. 15, 2013, both of which are incorporated herein by reference in their entireties.

BACKGROUND

The present application relates to sweeper vehicles. In particular, the present application relates to the operation of a broom for a snow removal truck. A snow removal truck may include a broom for sweeping or throwing snow. The bristles of the broom wear down over time as the broom is used. The wear of the bristles affects the performance of the broom. Conventionally, a vehicle operator must frequently inspect bristle length and/or manually adjust the vertical position of the broom relative to the ground in an effort to achieve a desired pattern of snow removal.

SUMMARY

One embodiment relates to a broom assembly for a vehicle that includes a frame, a broom core axle assembly rotatably coupled to the frame and defining an axis around which a broom rotates when in use, an actuator coupled to the frame and positioned to raise and lower the broom core axle relative to the frame, and a controller. The controller has an output for adjusting the actuator and an input for receiving information from a sensor. The controller is configured to use the received information to automatically lower the broom core axle over a period of operation to account for an estimated wear of the broom and to use the sensor input to controllably adjust the actuator to a position setpoint changing over the period of operation to account for the estimated wear. After the period of operation, the controller is configured to use the sensor input to determine a current position, to add an offset to the current position to achieve a new sensor target setpoint, and to use the new sensor target setpoint to adjust the output.

Another embodiment relates to a vehicle that includes an engine coupled to a chassis, a broom assembly and a controller. The broom assembly includes a frame, a broom core axle rotatably coupled to the frame and defining an axis around which a broom rotates when in use, and an actuator coupled to the frame and positioned to raise and lower the broom core axle relative to the frame. The controller has a variable output for adjusting the actuator and an input for receiving information from a sensor. The controller is configured to use the received information to automatically lower the broom core axle over a period of operation to achieve a target amount of brush contact with the ground. After the period of operation, the controller is configured to use the sensor input to determine a current position, to add an offset to the current position to achieve a new sensor target setpoint, and to use the new sensor target setpoint to adjust the variable output.

Yet another embodiment relates to a method of controlling the position of a broom that includes estimating wear of the broom using received sensor information and controllably lowering the broom over a period of operation to at least one of account for the estimated wear of the broom and achieve a target amount of brush contact with the ground.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to the figures, systems and methods for controlling broom operation of a vehicle (e.g., a snow removal truck) are shown and described. The systems and methods described herein assist a vehicle operator by automatically adjusting the position (e.g., the vertical position) of the broom of the truck over time. For example, during broom operation, the bristles of the broom may gradually wear away. Therefore, the broom may be gradually lowered over a period of time. Lowering the broom may provide for a consistent broom pattern (i.e. the width of a patch formed by contact of the broom's bristles with a ground surface) having particular dimensions (e.g., a width of two to four inches). The broom maintains a constant sweep pattern despite the bristle wear. The contact area between the ground and the broom of the truck is generally referred to as the broom pattern in the present disclosure.

In some embodiments, the rate of lowering of the broom is different during different stages of bristle wear. For example, in a first stage of broom wear, the position of the broom may be lowered $1/16^{th}$ of an inch every 30 minutes during operation. When the broom wear reaches a particular threshold (e.g., 50% of broom wear, 80% of broom wear, etc.), a broom controller may move to the next stage, with its own broom position and interval of time settings (e.g., lowering the broom every 25 minutes or 20 minutes). By adjusting the position of the broom, a pattern of contact between the broom and ground (e.g., the broom pattern) may be advantageously be maintained with a reduced amount of manual monitoring. For example, the position of the broom may be adjusted such that the broom pattern is between two and four inches at any given time.

Figure 1A:
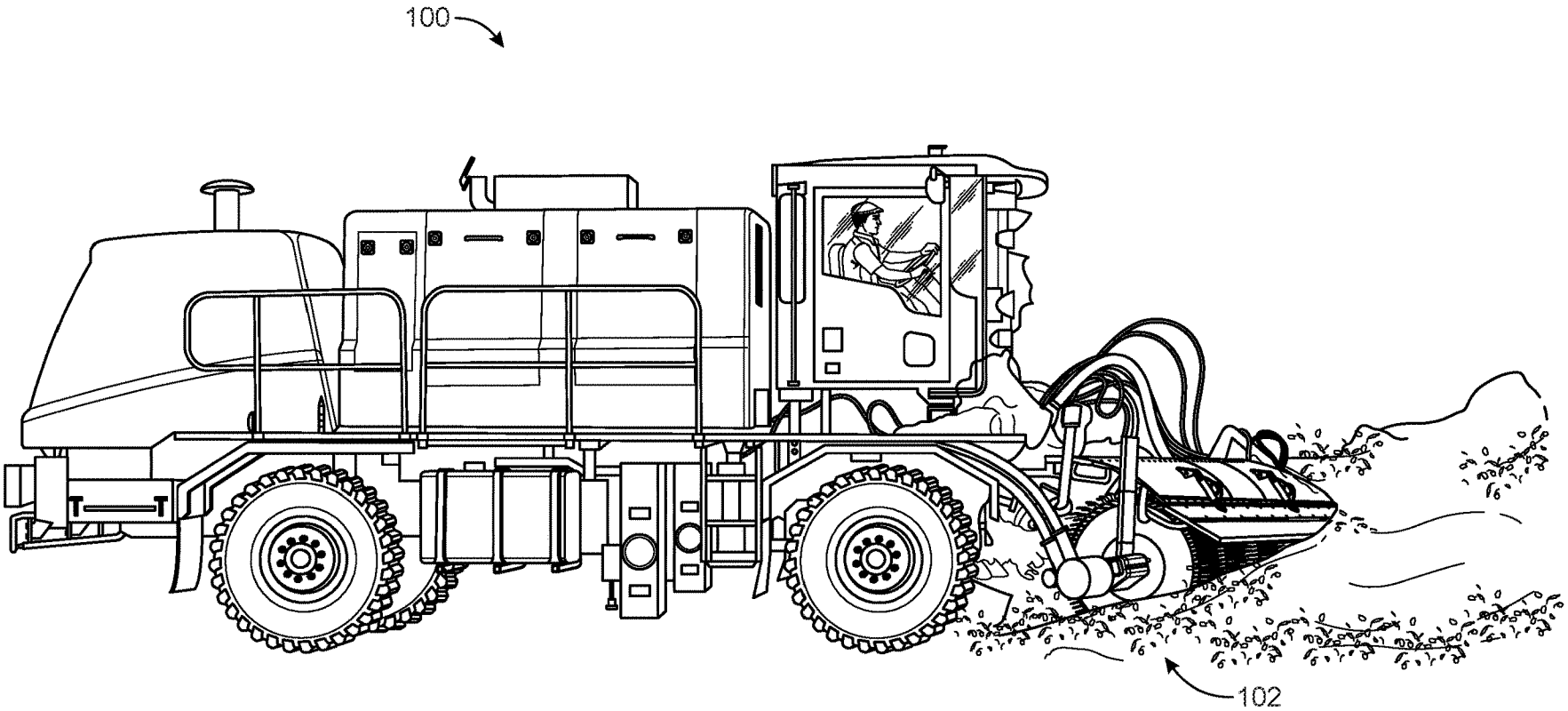
FIGS. 1A-B are perspective views of a snow removal truck, according to an exemplary embodiment.
Figure 1B:
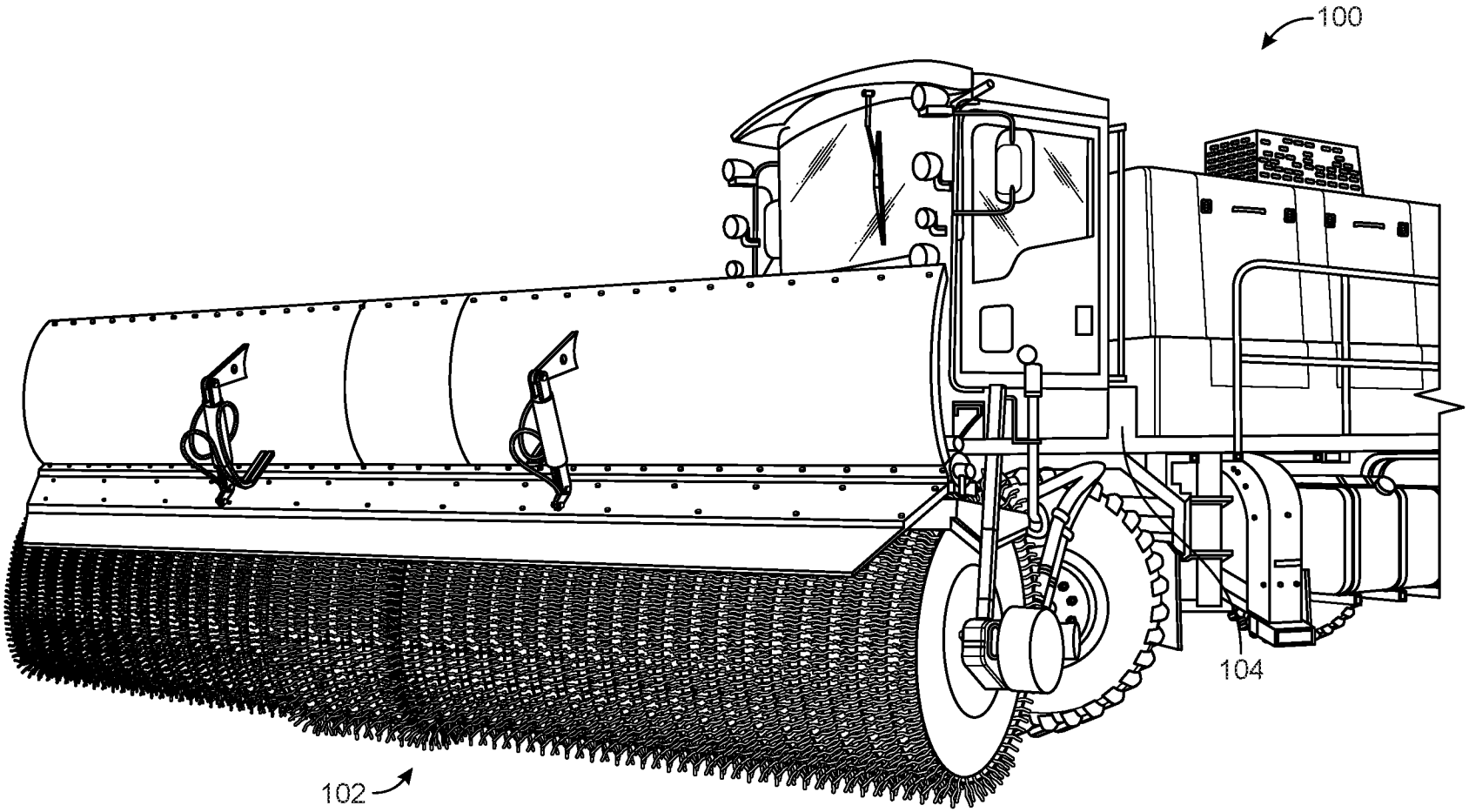

Referring to the exemplary embodiments shown in FIGS. 1A-B, a vehicle, shown as a snow removal truck 100, includes a broom 102. Broom 102 may be utilized to remove material (e.g., snow, debris, etc.) from a surface (e.g., an airport runway, a road surface, a sidewalk, etc.). Broom is rotated during movement of truck 100 and clears snow by rotation of broom 102 against snow on the ground.

Figure 1C:
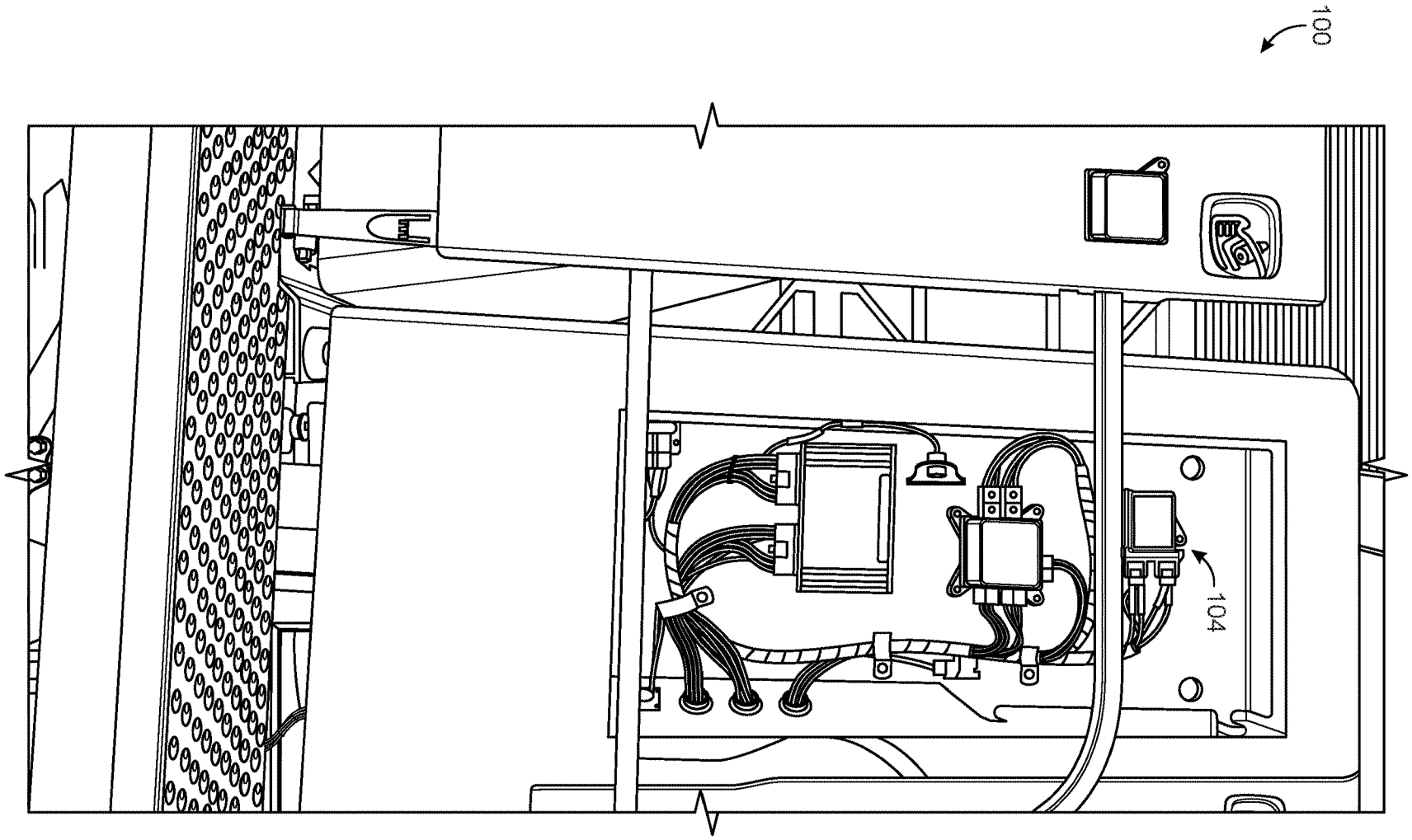
FIG. 1C is a perspective view of a broom controller of the snow removal truck, according to an exemplary embodiment.

Referring to FIG. 1C, the broom controller 104 of snow removal truck 100 is shown. Broom controller 104 may be housed anywhere within snow removal truck 100. For example, in FIG. 1C, broom controller 104 is shown housed within a panel on the side of truck 100, having a wired connection to broom 102 and other components in truck 100. A possible location of broom controller 104 is illustrated in FIG. 1B, but it should be understood that broom controller 104 may be located anywhere on truck 100. Broom controller 104 adjusts the position of broom 102 relative to the ground. Broom controller 104 may receive a user input related to the broom position, speed, or other variables. Broom controller 104 can use one or more I/O modules (i.e., slave I/O modules) which facilitate the connection of broom controller 104 to various input/output devices (e.g., a user interface display, user controls such as buttons, a position sensor for the broom position, a hydraulic system, etc.).

Figure 1D:
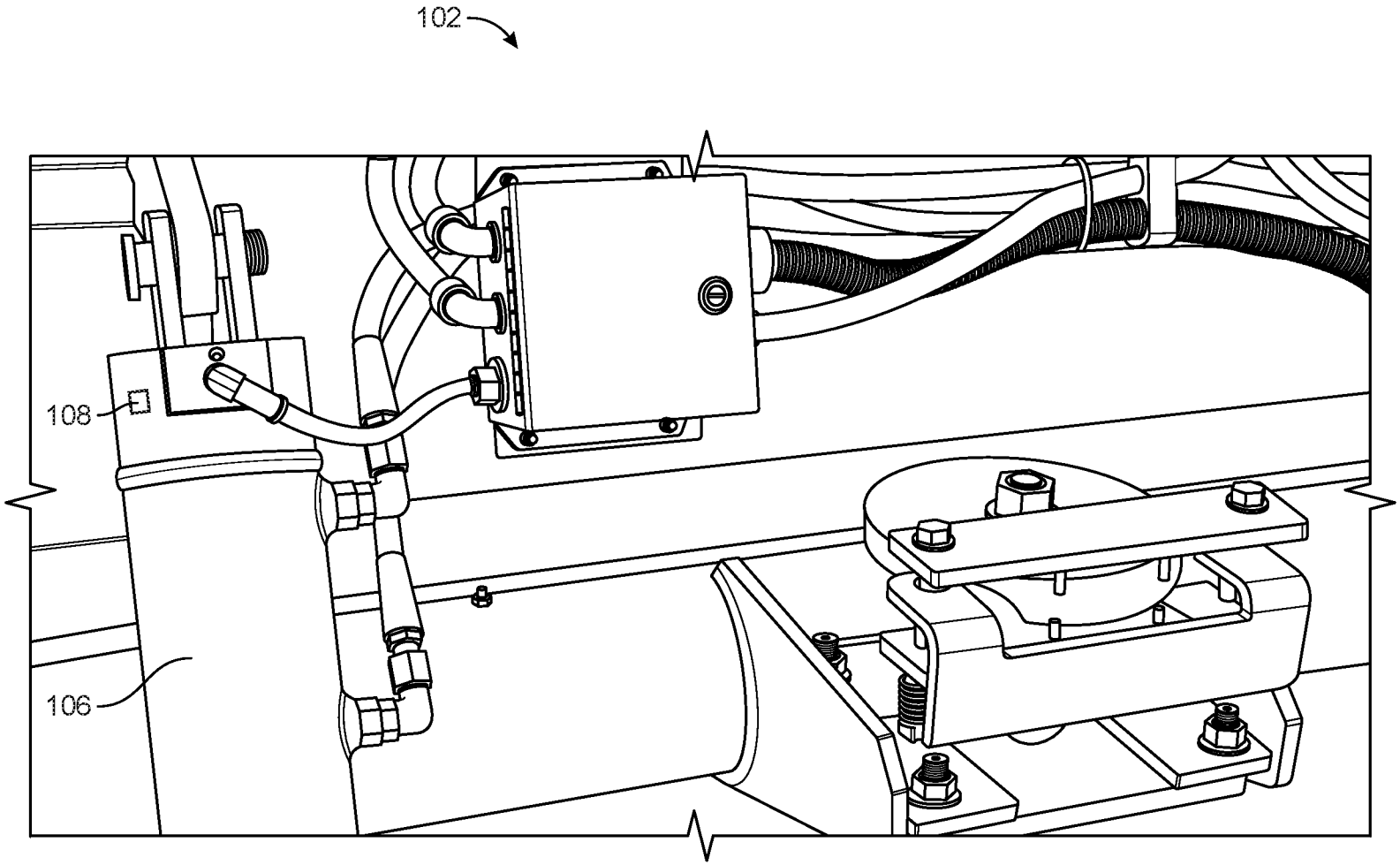
FIG. 1D is a perspective view of a hydraulic cylinder for adjusting the position of the broom of the snow removal truck and position sensors for sensing the position of the broom, according to an exemplary embodiment.

Referring to FIG. 1D, a hydraulic cylinder 106 of the broom core is shown on broom 102. Hydraulic cylinder 106 is configured to adjust the position of the broom core, and therefore the position of broom 102 relative to ground. A linear position sensor 108 is shown on hydraulic cylinder 106 and may be embedded within hydraulic cylinder 106. Linear position sensor 108 sends broom core position information to broom controller 104. Linear position sensor 108 may detect the position of broom core hydraulic cylinder 106. In varying embodiments, the position of hydraulic cylinder 106 can be transformed into information about the distance of the broom core relative to the ground, relative to a point of reference on truck 100, or otherwise. In other embodiments the position of the broom core, broom bristles, or another structure associated with broom 102 is directly measured.

Figure 2:
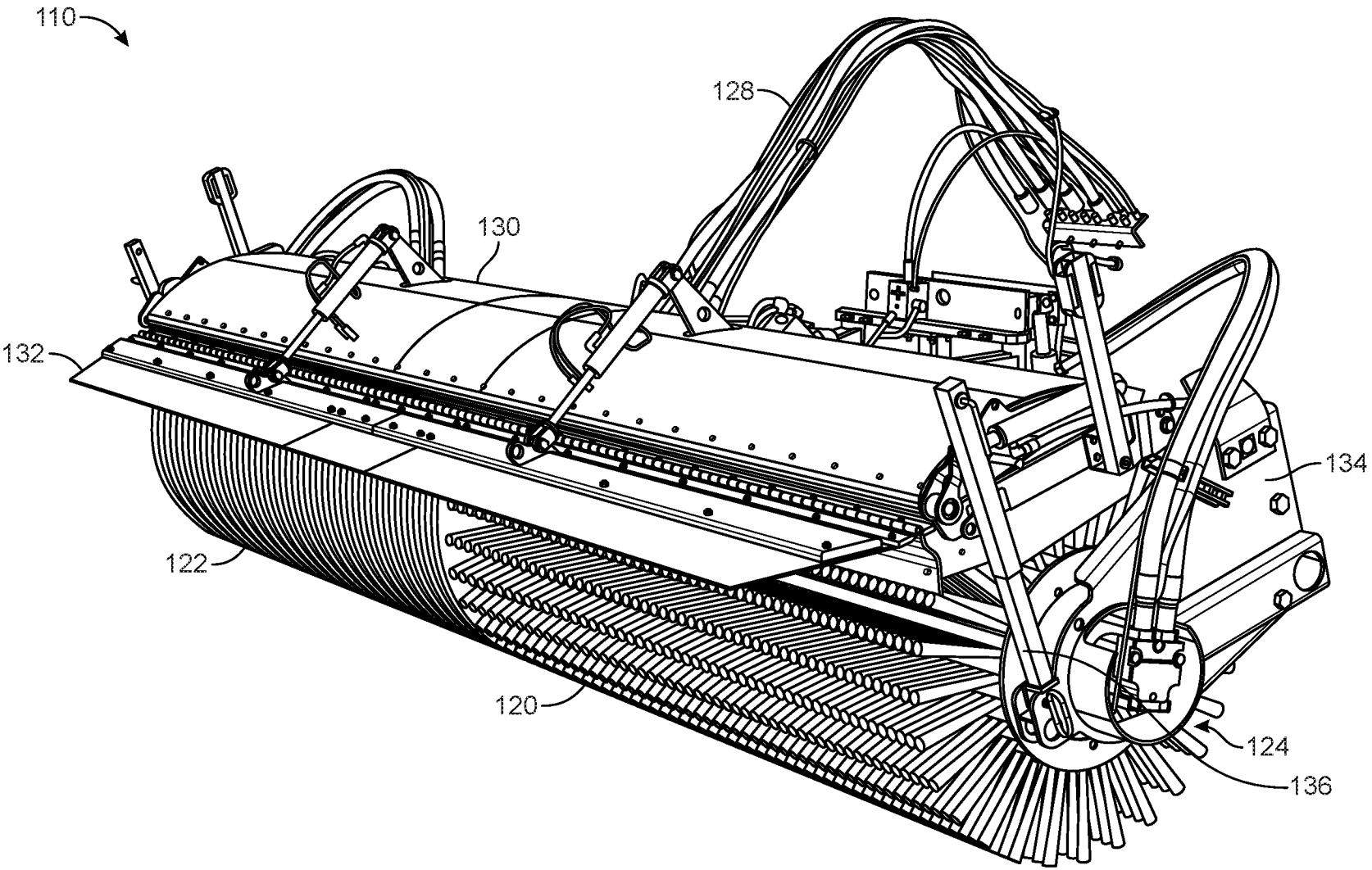
FIG. 2 is a front perspective view of a broom of a snow removal truck, according to an exemplary embodiment.
Figure 3:
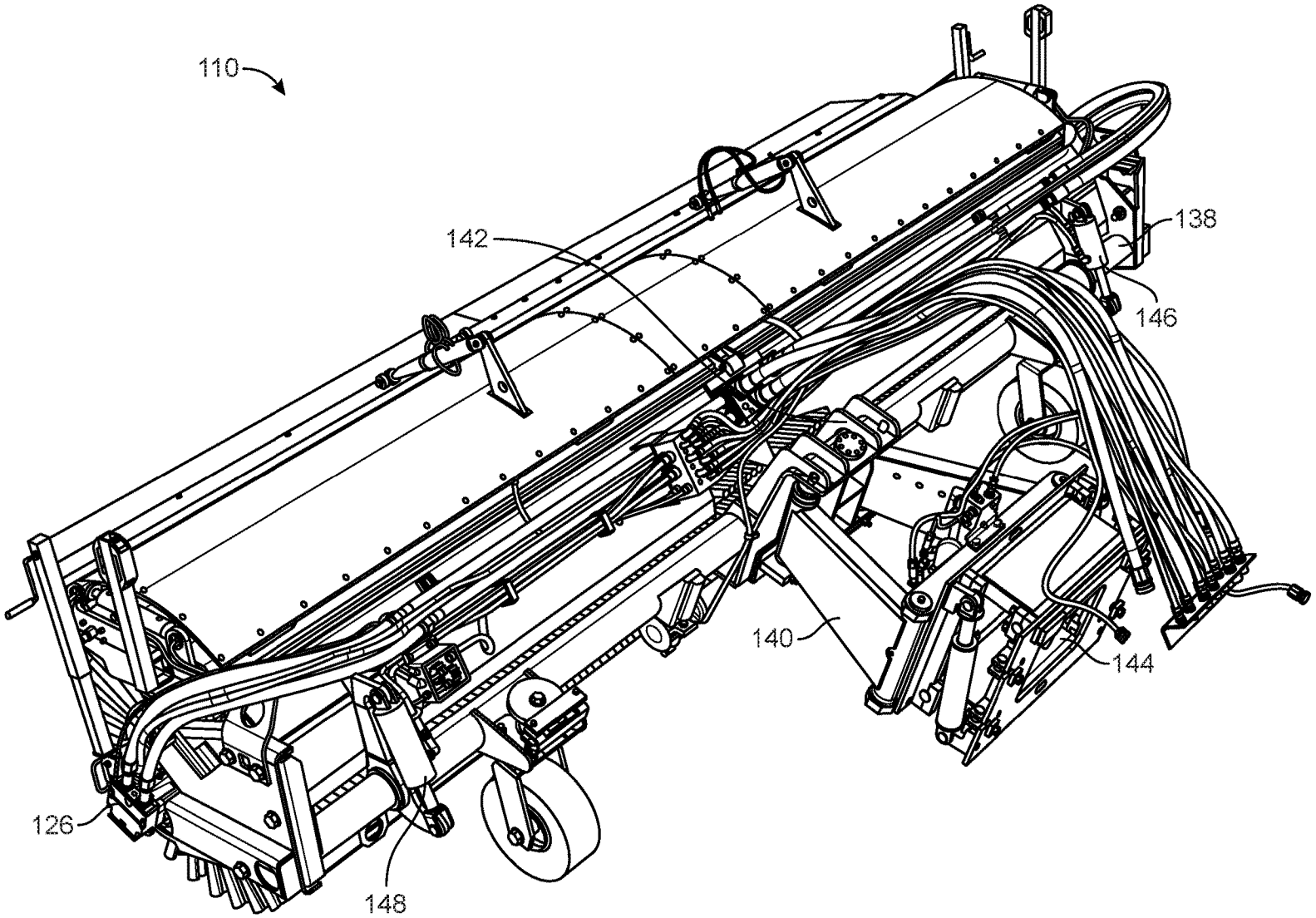
FIG. 3 is a rear perspective view of a broom of a snow removal truck, according to an exemplary embodiment.

Referring to FIGS. 2-3, perspective views of a broom assembly 110 of broom 102 are shown in greater detail. Broom assembly 110 may generally include a frame and a broom core axle held by the frame. The broom core axle defines an axis around which broom 102 rotates (around pivot 138 as shown in FIG. 3).

Broom 102 includes bristles that wear over time and a broom core that couples to the broom core axle and to the bristles. The bristles may be of any style, type, or a variety of styles or types. For example, in the embodiment of FIG. 2, broom 102 is illustrated with cassette style bristles 120 and wafer style bristles 122. Broom 102 may generally include cassette style bristles, wafer style bristles, or any other type of bristle pattern or combination of bristle patterns. In one embodiment, the bristles are plastic bristles estimated to have a slow rate of wear. In another embodiment, the bristles are steel bristles that may wear down faster. The systems and methods of the present disclosure may be used in conjunction with any type of broom and bristles, and may be configured to adjust a broom pattern, broom wear rates, and other broom properties based on the type of broom and type of bristles used. Broom 102 and the bristles may be of any size. In one embodiment, broom 102 is circular and may have a diameter of 46 inches. In other embodiments, broom 102 diameter may be 18 inches, 20 inches, 22 inches, or another size.

Broom assembly 110 includes a hydraulic drive motor 124 configured to control the rotation of broom 102 (e.g., to control the broom RPM). Hydraulic drive motor 124 may be, for example, a 100 cc, 5000 PSI, 87 GPM engine that can rotate broom 102 anywhere from 50 RPM to 550 RPM through a 6:1 gear box. Broom assembly 110 further includes a motor speed sensor 126 that measures the broom rotation speed and transmits the broom rotation speed to broom controller 104. The broom rotation speed is used by broom controller 104 to help to determine a broom wear rate (e.g., using the broom rotation speed along with the bristle type to determine how quickly the bristles wear down).

Referring to FIG. 2, broom 102 may receive hydraulic power for the hydraulic cylinders, and may further receive controls from broom controller 104 (e.g., located in the chassis of the truck) relating to hydraulic cylinder position, from connection 128. Broom assembly 110 may further include a snow shed hood 130, snow deflector 132, or other parts to deflect snow from broom 102. Such parts may be, for example, plastic. Broom assembly 110 may include a slidable drive end 134 for replacing broom 102 when the broom is worn out, and a jack 136 to manually adjust the height of snow shed hood 130 (e.g., for adjusting the height based on the current state of wear of the bristles).

Referring to FIG. 3, broom assembly 110 is shown to include a swing hitch 140. Swing hitch 140 is configured to control the deployed angle of broom 102 (i.e., the angle of broom 102 relative to truck 100 and the ground). Broom assembly 110 further includes a pivot pin 142 to rotate broom 102 (e.g., with 12° contour capability) and a din hitch 144 configured to transfer swing hitch 140 weight.

The broom assembly is shown to include two lift cylinders 146, 148. Broom lift cylinders 146, 148 serve as an actuator configured to control the position of broom 102. In order to lower the position of broom 102, broom lift cylinders 146, 148 may expand by a set amount. In order to raise the position of broom 102, broom lift cylinders 146, 148 may contract by a set amount. Broom lift cylinders 146, 148 may be adjusted based on an output from broom controller 104.

Figure 5A:
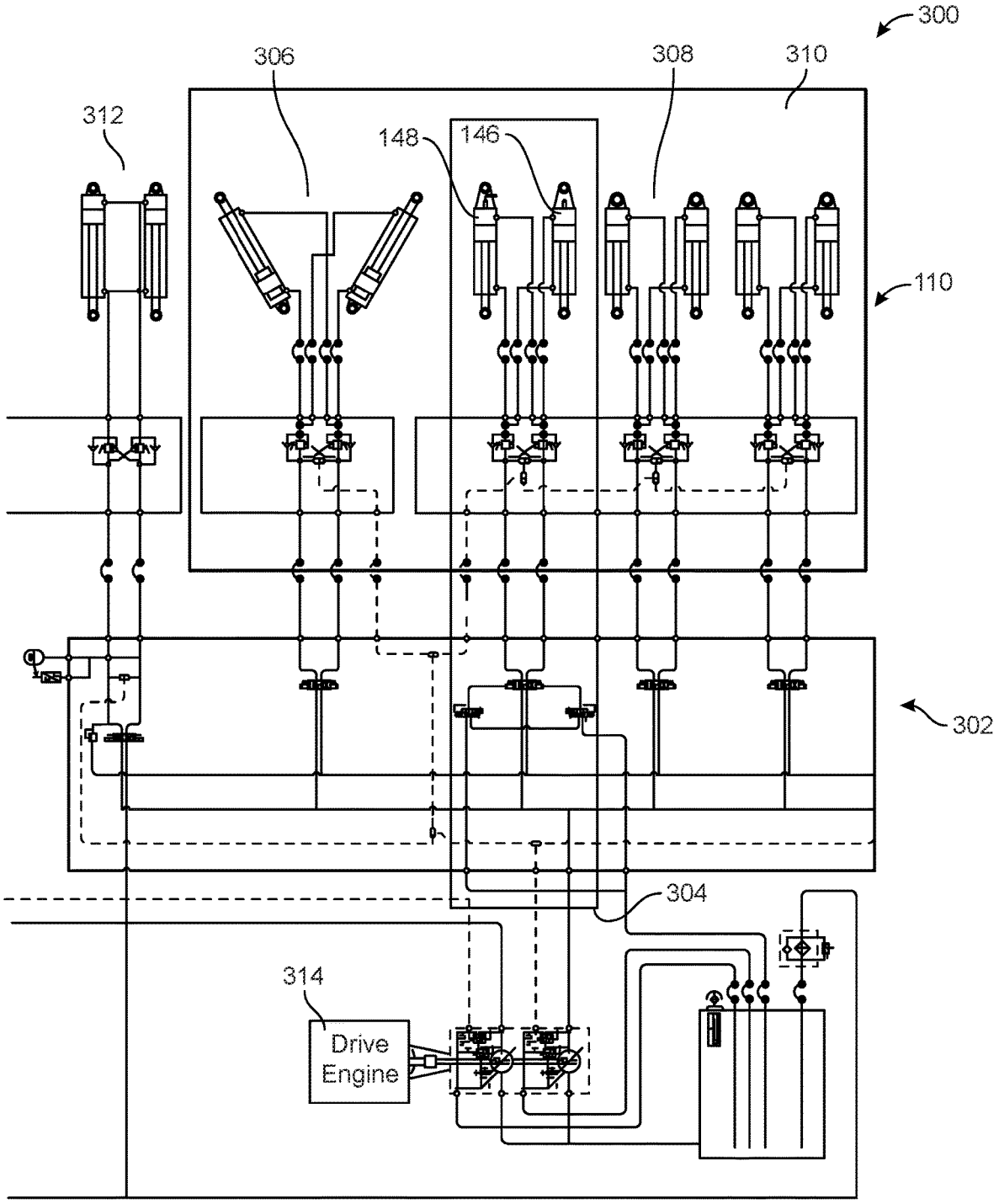
FIG. 5A is a schematic diagram of the hydraulic system of the broom and snow truck, according to an exemplary embodiment.
Figure 5B:
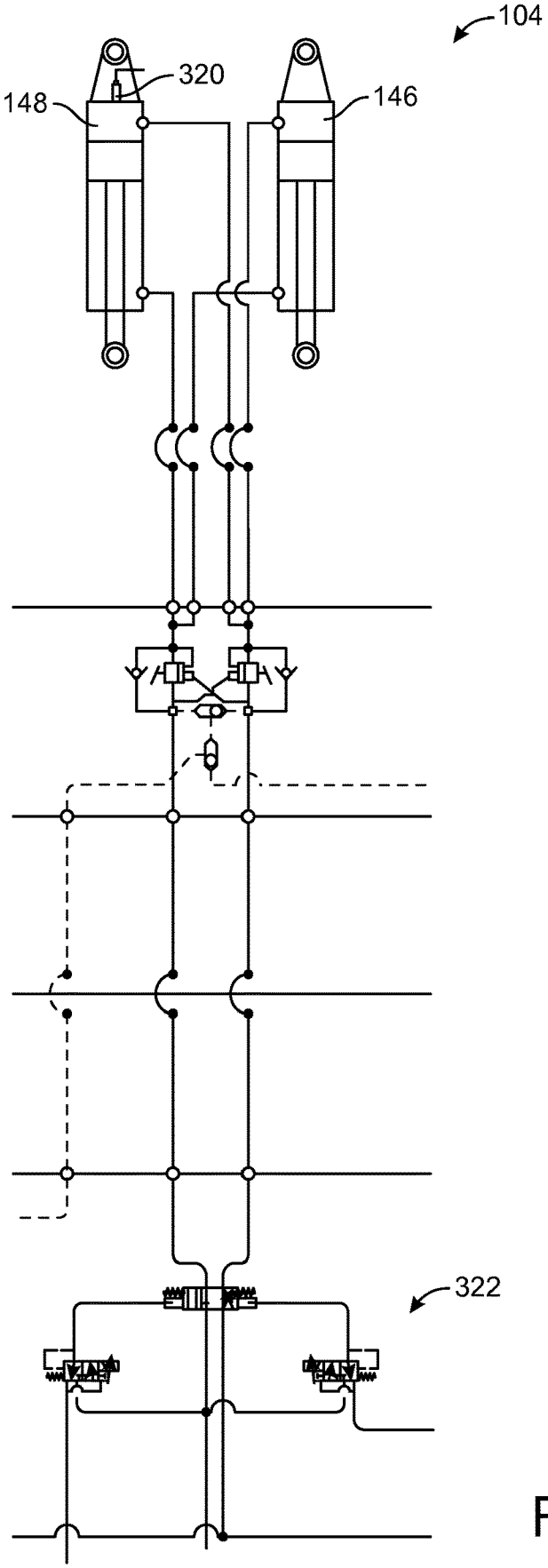
FIG. 5B is a schematic diagram of the hydraulic system of the broom and the controls for lifting and lowering the broom of the snow removal truck, according to an exemplary embodiment.

In one embodiment, one of the broom lift cylinders includes a sensor (shown in greater detail in FIGS. 5A-B). For example, left lift cylinder 148 may include a sensor or may have a sensor embedded within the cylinder. Lift cylinder 148 may then be identified as the linear position cylinder. The sensor detects the position of the hydraulic cylinder and provides the position information to broom controller 104 for determining a broom position. In other embodiments, the sensor may be located elsewhere, or each broom lift cylinder 146, 148 may include a sensor. Broom lift cylinders 146, 148 and their operation are shown in greater detail in FIGS. 5A-B.

Broom assembly 110 includes a pivot. The broom core may be hinged around the pivot such that the brush pattern of broom 102 is changed when the broom core axle position is changed. Broom assembly 110 and broom 102 may generally include various other features for snow removal and other like operations as is known in the art (e.g., sealed junction boxes for holding the wiring that connects broom assembly 110 to broom controller 104 and a power supply, electric vibrator, etc.).

Figure 4A:
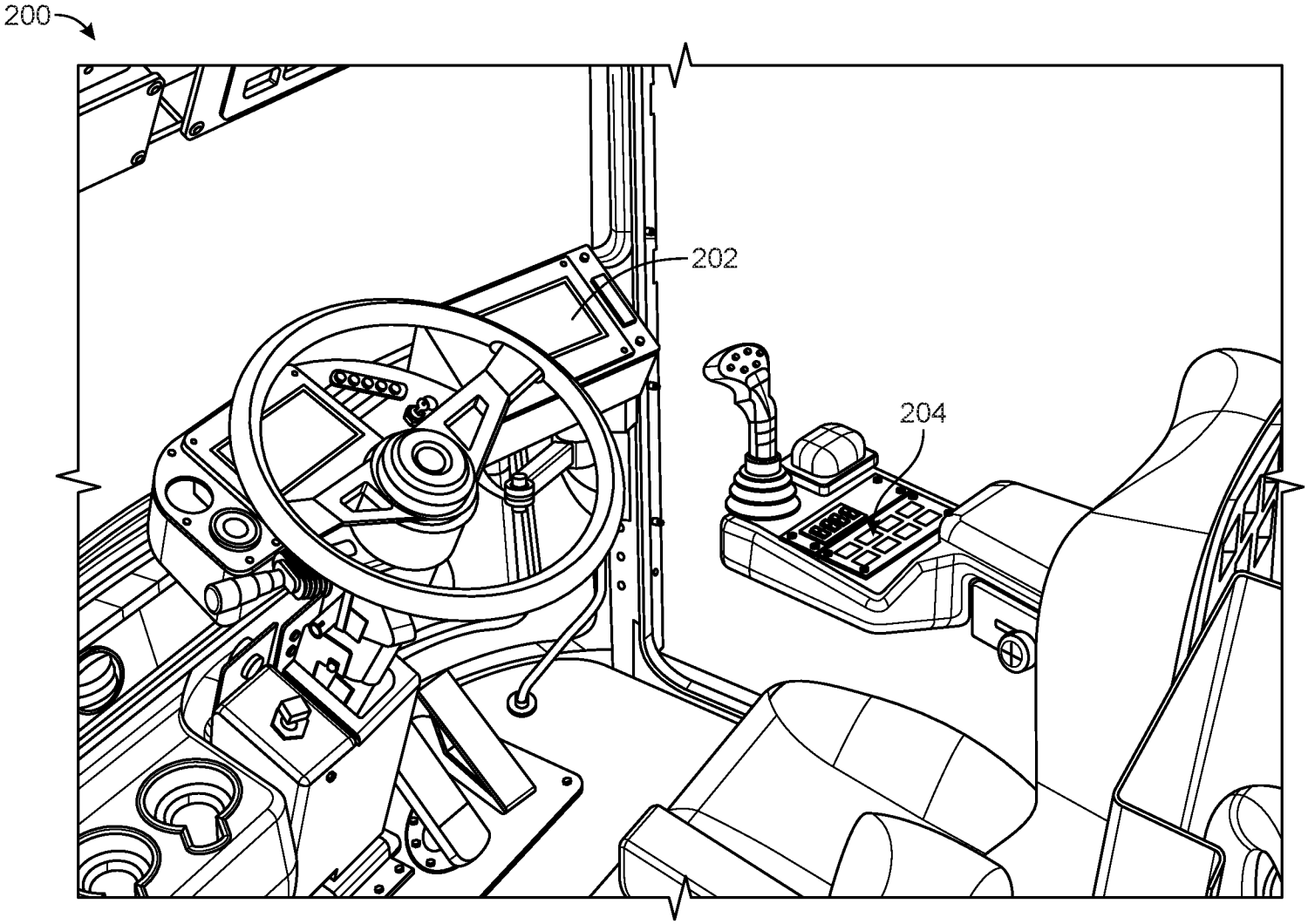
FIGS. 4A-4E illustrate various user interfaces that may be used to provide user inputs to the broom controller and the broom assembly for operation, according to an exemplary embodiment.

Referring to FIGS. 4A-E, various user interfaces that a user may use to interact with broom controller 104 and broom assembly 110 are shown, according to exemplary embodiments. As shown in FIG. 4A, truck interior 200 is shown to include a user interface including a display 202 and inputs 204. Display 202 may be configured to display one of the graphical use interfaces as shown in FIGS. 4B-E. Inputs 204 may be used by an operator of snow removal truck 100 to provide commands to broom controller 104. For example, inputs 204 may include one or more buttons, knobs, touch-screens, switches, levers, or handles. In one embodiment, an operator may press a button to increase or decrease a pattern of broom 102 as described below, to change a mode of operation of broom 102, or otherwise. The operator may be able to manually control some or all aspects of broom operation using display 202 and inputs 204. It should be understood that any type of output display or input controls may be implemented with the systems and methods described herein.

Figure 4B:
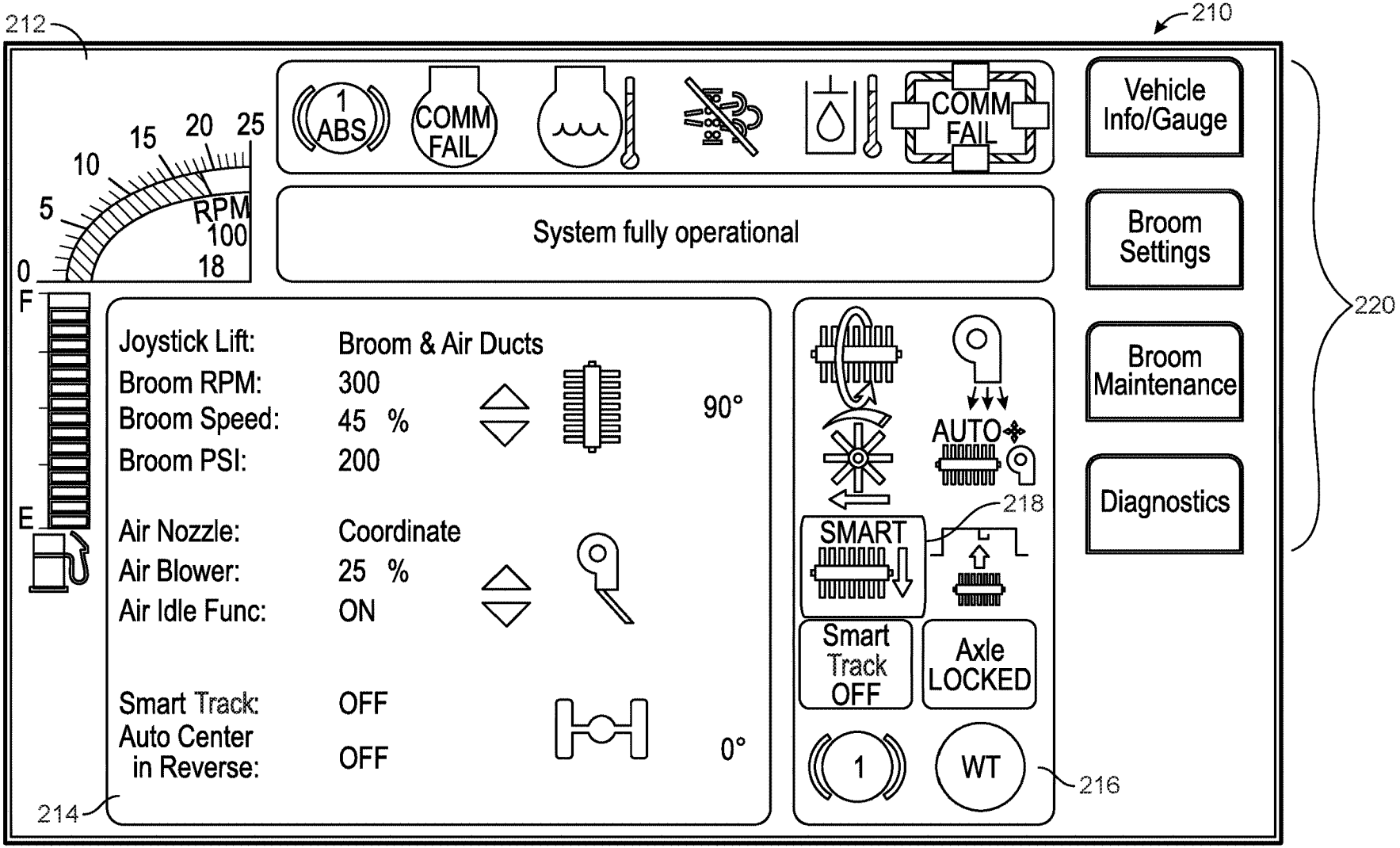

Referring now to FIG. 4B, an exemplary display 210 is shown. Display 210 may be a user interface configured to display general information about truck 100. For example, display 210 may provide general vehicle information 212, such as a vehicle speed, fuel level, and other typical vehicle indicators, and also one or more warning lights related to general truck 100 operation. Such information is generally illustrated on display 210 on the top and left portions of the screen.

Display 210 may further display broom properties 214. Broom properties 214 may include, for example, the current broom RPM (revolutions per minute) (300 RPM), the broom speed percentage (45%), and the broom PSI (pounds per square inch) (200). These broom properties may generally relate to the current mode of broom operation (e.g., how fast the broom is rotating and the pressure the broom is applying to the ground and the material being swept by the broom). Such properties may generally relate to how fast a broom and its bristles are wearing out. Broom properties 214 may further include information related to an air blower of truck 100 (e.g., a blower for blowing away debris from the broom), to a particular broom pattern (e.g., a "smart pattern" as described below), a current broom position (e.g., broom position to the ground, an angle the broom is at compared to the ground, etc.), or otherwise. Broom properties 214 may further include an indication of the current broom wear (e.g., a percentage indicating how much the broom and bristles have worn down).

Display 210 may further include various icons 216 related to the current functionality of truck 100. Icons 216 may include an icon 218 indicating if a "smart pattern" of the broom is active. The "smart pattern" relates to a setting for the broom that adjusts the broom position based on broom wear and other properties. Display 210 may further include various selectable options 220. An operator may select one of options 220 to bring up another screen with more detailed information relating to vehicle information and vehicle gauges, maintenance, diagnostics, etc. With reference to the present disclosure, the operator may select the "broom settings" option to bring up display 230 of FIG. 4C.

Display 230 is shown to include various broom settings 232 that an operator may view and/or adjust. Broom settings 232 may generally relate to a current position and mode of operation for broom 102 and broom assembly 110. For example, broom settings 232 may include a joystick lift setting, air nozzle coordination setting, air blower idle function setting, and a broom speed ramp rate, that may generally control how the broom, air blower, and user interface are operated in truck 100. Broom settings 232 may further include a ground speed function setting that may control truck 100 speed when activated, a smart pattern adjustment setting that indicates how many times the broom position has been adjusted, and a snow shed setting that controls the position of the snow shed and other broom deflectors.

Broom settings 232 may further include a smart pattern function setting 234. Setting 234 indicates if a smart pattern is active or not. The smart pattern may generally automatically control the position of broom 102 relative to the ground and snow removal truck 100. Display 230 further includes a plurality of options 236 that allow the operator to scroll between various broom settings 232.

Broom settings 232 may further include an increment/decrement lock setting. The lock settings may indicate to the operator whether or not the smart pattern is locked. A maintenance manager, supervisor, etc. may lock the operator from changing the broom pattern (e.g., how much to lower the broom position) in order to prevent the operator from wearing out the broom too quickly by adjusting the broom position too far downward or too fast.

Broom settings 232 further includes an indication if the some or all of the broom settings are locked. For example, some settings feature a lock icon next to the setting, indicating that the operator cannot change the settings (e.g., a maintenance manage has locked the setting, not allowing the operator to change it).

Figure 4C:
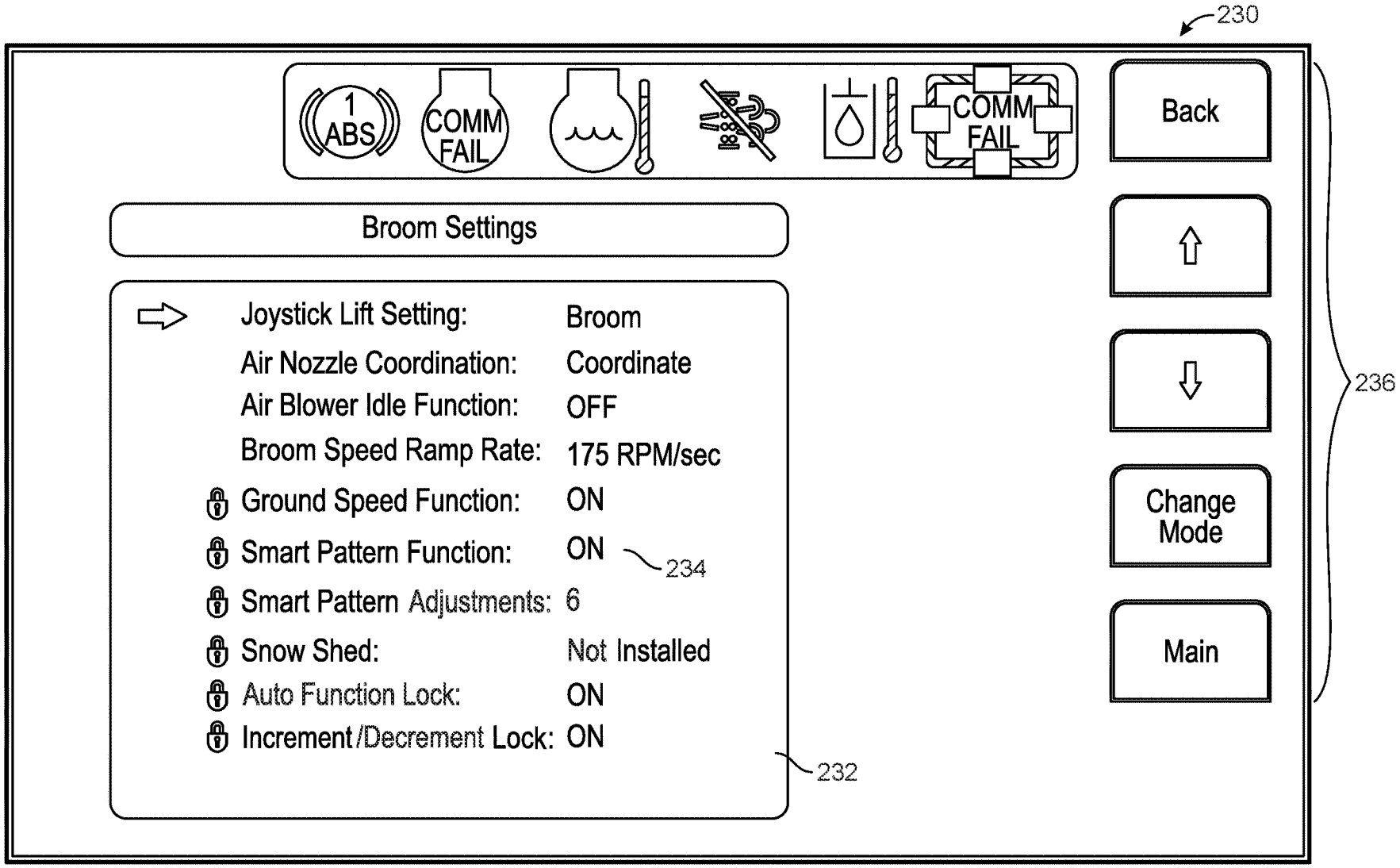
Figure 4D:
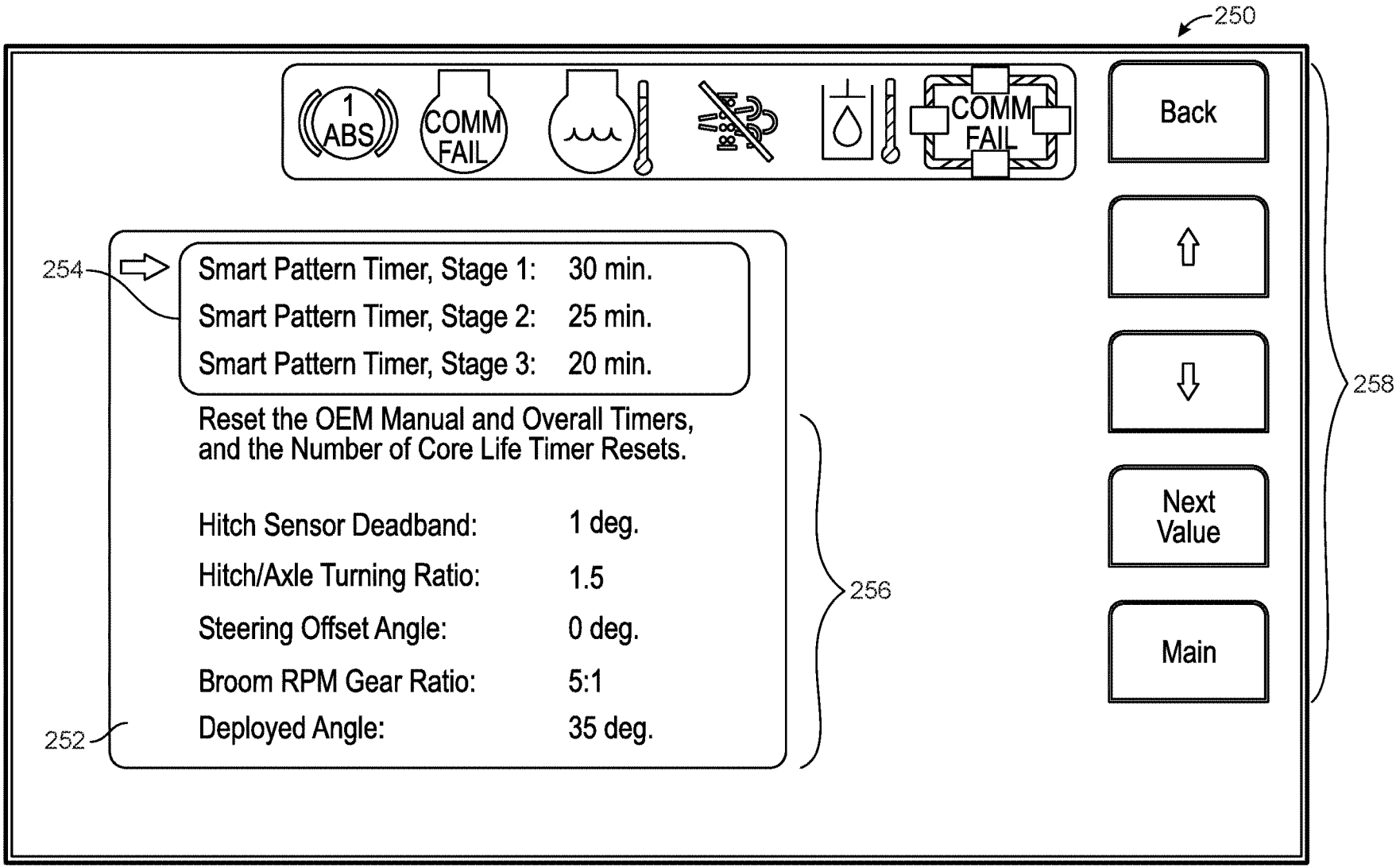

Referring now to display 250 of FIG. 4D, the operator may view and adjust the smart pattern of the broom. The operator may access display 250 via selecting the "change mode" option 236 of display 230, for example. The smart pattern of the broom relates to the position of broom 102 to truck 100 and the ground based on the current broom status (e.g., the wear of the bristles of the broom). The smart pattern is adjustable over time. For example, as broom wear increases over time, the position of broom 102 is adjusted downward to account for the broom wear. The rate of adjustment over time may be variable as well (e.g., the broom may be adjusted downward every 30 minutes in a first stage of broom wear, 25 minutes in a second stage of broom wear, etc.). The smart pattern of the broom may further relate to an angle of broom 102 to the ground, broom 102 speed, or any other broom property that impacts the broom contact with the ground.

Display 250 is shown to provide a plurality of smart pattern settings 252. Smart pattern settings 252 include smart pattern timer settings 254. Timer settings 254 relate to a period of time in between adjustments for each stage of broom wear. In the example of FIG. 4C, there may be three stages of operation of the broom. The first stage may be a stage where the broom wear is between 0% and 50% (e.g., between the broom having no wear and the broom being half worn-out). The second stage may be a stage between 50% and 80% broom wear, and the third stage may be a stage between 80% and 100% broom wear. Within each stage of broom wear, the rate of broom wear may be different (e.g., a broom may wear out faster over time). It should be understood that in other embodiments, there may be more or less than three stages of broom wear that may be set for the smart pattern.

The operator may set a timer for each stage of broom wear. For example, while the broom is in a first stage of wear (between 0% and 50%), broom controller 104 may be configured to move the position of broom 102 down $1/16^{th}$ of an inch every 30 minutes. In the second stage of wear (50%-80%), broom controller 104 lowers the position of broom 102 down $1/16^{th}$ inch every 25 minutes. In the third stage of wear (80%-100%), broom controller 104 lowers the position of broom 102 down $1/16^{th}$ inch every 20 minutes. The operator may adjust the periods of time for any stage to any desired time via the user interface. For example, the operator may choose any time interval in 5 minute increments, up to a maximum of 60 minutes, or any other period of time may be set). In another embodiment, the operator may adjust the broom wear thresholds (from 50% or 80% to other thresholds) at which the broom controller transitions from one stage to the next. In another embodiment, the operator may add or remove stages (e.g., adding a stage in between the second and third stages, removing the second stage, etc.). In another embodiment, the operator may adjust how the broom position is adjusted (e.g., to lengths other than $1/16^{th}$ of an inch).

In one embodiment, the operator may adjust the settings of the smart pattern based on the type of bristles on the broom. For example, if the broom has steel bristles, the bristles may wear down faster, and the operator may decrease the time in between position shifts of broom 102. As another example, if the bristles are polyurethane, the bristles may wear down slower, and the operator may increase the time in between position shifts of broom 102. The operator may further use his or her own judgment (e.g., based on if outside conditions may increase or decrease the broom wear rate) to adjust the smart pattern settings accordingly.

Other smart pattern settings 256 may be changed on display 250. For example, the operator may view (or adjust) the hitch sensor deadband threshold (shown as 1 degree), a hitch/axle turning ratio (1.5), a steering offset angle (0 degrees), a broom RPM gear ratio (5:1), and a deployed angle of the broom (35 degrees). Such settings may generally relate to a broom speed (which may impact the rate at which the bristles wear), a broom angle relative to the ground (which may impact the pressure between the broom and ground, and therefore the broom wear rate, and also the coverage area of the broom), and other properties relating to broom 102 operation. Upon changing the settings, broom controller 104 may be configured to receive the input and to re-determine a broom position or settings for one or more stages of broom operation. Such settings may be used to help prevent the broom controller from prematurely adjusting between different stages, oscillating in between different modes, helping manage broom wear, and so forth. Display 250 may further include options 236 for allowing the operator to change screens, select options, etc.

Figure 4E:
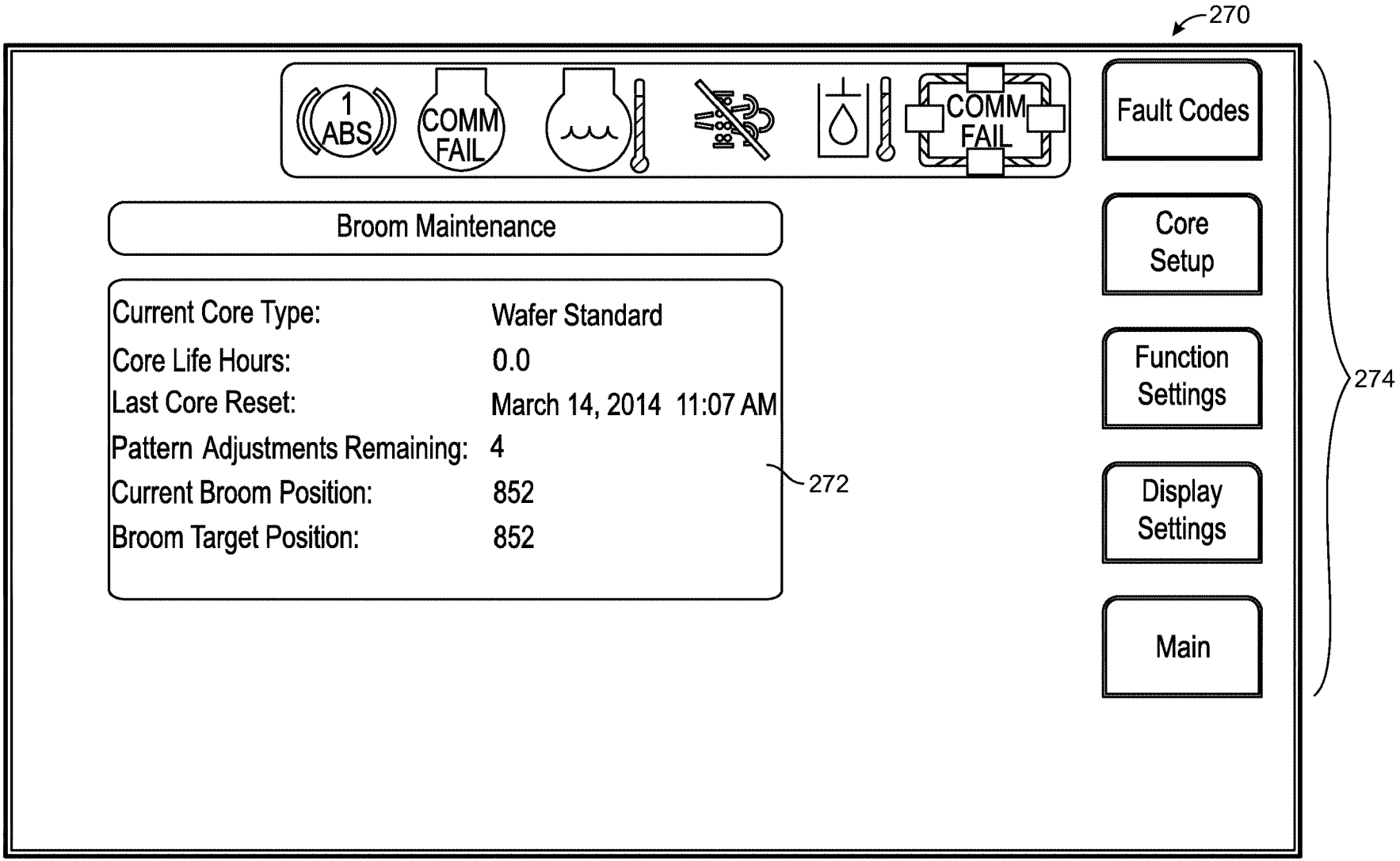

Referring to display 210, the operator may select broom maintenance option 220 to bring up display 270 of FIG. 4E. Display 270 may generally provide the operation with broom maintenance information in broom maintenance properties 272. Broom maintenance properties 272 may include, for example, the current core type of the broom (e.g., wafer style, cassette style, etc.), the core life hours (e.g., the estimated time the broom core will last before wearing out), and a timestamp of when the broom core was last replaced. Broom maintenance properties 272 may further include broom properties relating to the current use of the broom in a smart pattern. For example, an indication of the number of pattern adjustments remaining may be provided (e.g., a number of adjustments that may be made to the broom position without compromising the condition of the broom core). Broom maintenance properties 272 may further include the current broom position and the target broom position. Broom maintenance properties 272 may generally be used the operator to help determine whether manual adjustment of the smart pattern is needed. Display 270 may further include selectable options 274 that may allow the operator to view further properties, to view fault codes, to view and change the broom core setup, and to view and change properties relating to the function of the broom or display 270.

Referring now to FIG. 5A, a schematic diagram of the hydraulic system 300 of broom 102 is shown, according to an exemplary embodiment. Hydraulic system 300 is configured to control the position of the broom head in order to lift or lower broom 102 according to settings from broom controller 104. Hydraulic system 300 is connected to swing hitch 140 that couples broom 102 to truck 100.

Hydraulic system 300 is shown to include a portion physically located on broom assembly 110 and a hydraulic manifold 302 portion physically located below the cab of snow removal truck 100. Broom assembly 110 is shown to include various hydraulic cylinders for adjusting the position of broom 102. For example, broom assembly 110 includes broom swing cylinders 306 configured to adjust the position of swing hitch 140, snow shed cylinders 308 configured to adjust the position of hood 130, and snow deflector cylinders 310 to adjust the position of snow deflector 132. Broom assembly 110 further includes hydraulic cylinders 146, 148 as described above and with reference to FIG. 5B. Hydraulic system 300 further includes hitch lift cylinders 312 configured to adjust the position of hitch 144. Hydraulic system 300 further includes a drive engine 314 configured to change the position of cylinders 146, 148, 306-312.

Referring also to FIG. 5B, a close-up schematic view of a portion of hydraulic system 300 configured to adjust the position of broom 102 relative to the ground is shown. Hydraulic system 300 includes two broom lift cylinders 146, 148 as described above. Broom lift cylinder 148 is shown coupled to a position sensor 320. Broom lift cylinders 146, 148 are configured to expand or contract to change a position of broom 102.

Hydraulic system 300 is configured to control the lifting and lowering of the broom head based on an output from broom controller 104 based on the smart pattern. A proportional valve 322 of hydraulic system 300 is configured to control broom lift cylinders 146, 148. Proportional valve 322 may control broom lift cylinders 146, 148 by lowering or lifting the cylinders (to expand or contact the cylinders) to make the adjustments needed based on the smart pattern or a manual setting of the operator. Longer broom lift cylinders may lower the position of the broom, and shorter broom lift cylinders may raise the position of the broom. The force applied to two broom lift cylinders 146, 148 (to raise or lower the broom position) by proportional valve 322 may vary. For example, based on snow depth and other external factors, hydraulic system 300 may be configured to determine what force to use to adjust broom lift cylinders 146, 148.

Figure 6:
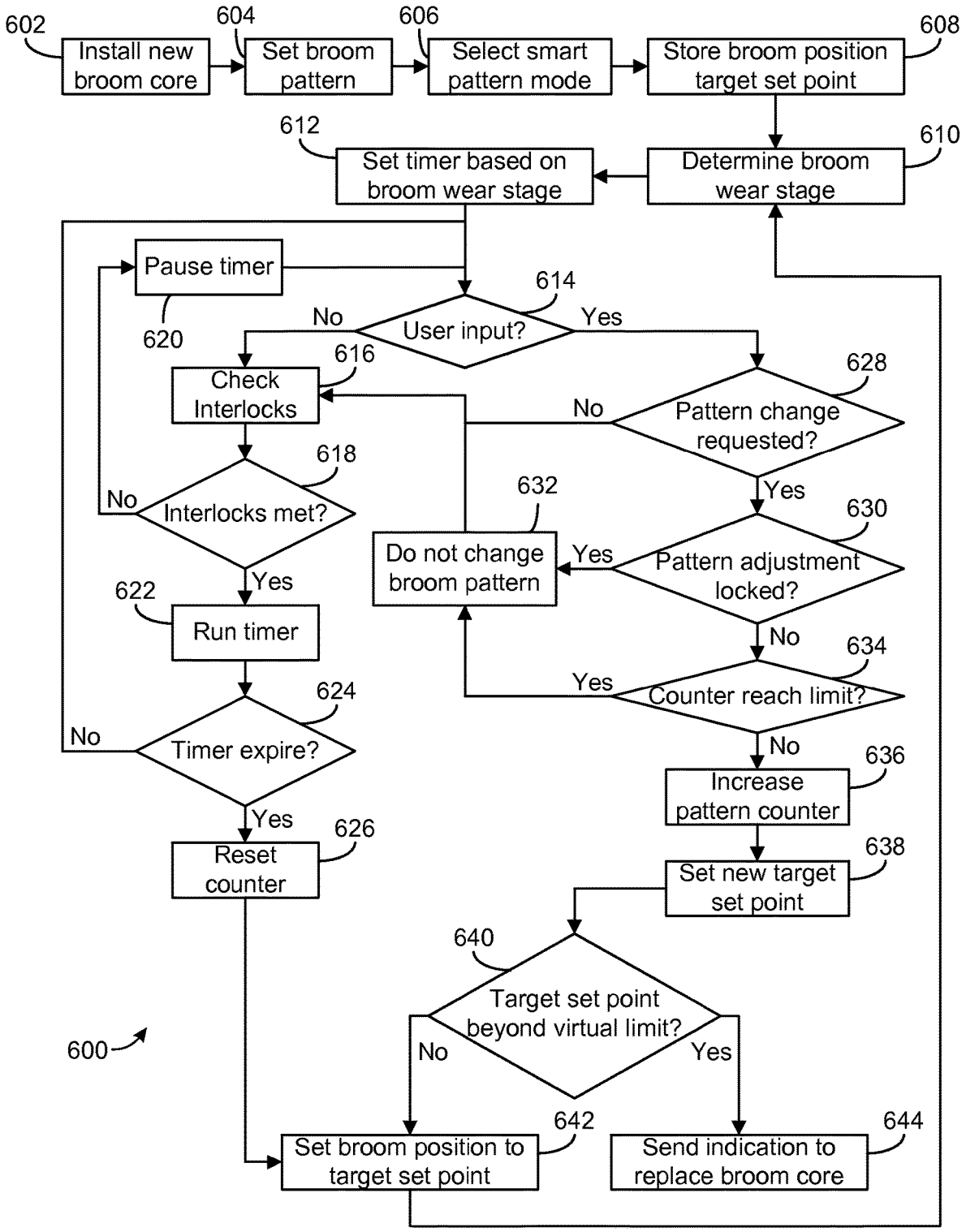
FIG. 6 illustrates a process for adjusting a broom position of the broom of the snow removal truck, according to an exemplary embodiment.

Referring now to FIG. 6, a flow chart of a process 600 for adjusting a broom position of a broom of the snow removal truck is shown, according to an exemplary embodiment.

Process 600 may be used to control a broom position over the life span of the broom. As the broom bristles wear down over time, the position of the broom may be adjusted based on an amount of time passed since the last broom position adjustment, the broom wear, and an operator input. Process 600 may be executed by an operator of the snow removal truck, by a broom controller for automatically controlling the broom position, or a combination of the operator and broom controller.

Process 600 begins with the installation of a new broom core on the snow removal truck (step 602). The installation of the new broom core may include providing broom details to the broom controller. For example, the broom core may be 46 inches long with no wear, and the information may be provided to the broom controller for estimating the broom wear in the future.

The operator (or maintenance manager or other user of the snow removal truck) sets a broom pattern for the broom (step 604). The broom pattern is representative of how the broom is contacting with the ground at any given time during operation. For example, the operator may set the broom pattern to be from 2 to 4 inches (e.g., the broom is in contact with an area 2 to 4 inches wide at any given time during sweeping), at 3 inches, or at any set value or range of values. The broom pattern information may be used to set an initial position of the broom lift cylinders.

The operator or broom controller sets a smart pattern mode (step 606). Step 606 may include an operator selecting whether or not to use a smart pattern, an operator selecting between multiple smart patterns, or an operator choosing to manually control the broom position. The operator may further specify any other details relating to the smart pattern (e.g., how long each stage lasts with respect to broom wear, how to adjust the position of the broom, or any other type of adjustment).

Operation of the broom begins. Process 600 includes determining a current broom position using the hydraulic linear position sensor. The broom position is stored as the broom position target set point by the broom controller (step 608). The target set point eventually decreases as process 600 continues and the broom core wears down.

At any given time (or on any given scheduled interval of time), the broom wear stage is determined (step 610). As the broom is used, the broom wear and broom wear rate may increase over time. The amount of broom wear may be determined based on an elapsed time of use of the broom, the type of bristle of the broom (e.g., plastic, steel, etc.), truck speed, and any other factors related to broom performance. The amount of broom wear may be expressed as a percentage of broom wear (e.g., 20% broom wear indicates that 20% of the bristles have worn down). The percentage is then used to classify the broom wear into a stage. As one example, a first stage may include 0% broom wear to 50% broom wear, a second stage may include 50% broom wear to 80% broom wear, and a third stage may include 80% broom wear to 100% broom wear. It should be understood that any number of stages may be included, and the threshold values for each stage may vary. Initially, the broom wear may be set at 0% (for a new broom core).

Based on the stage, a timer is set (step 612). The timer indicates an amount of time a current broom position should be held based on the current stage of broom wear. When the timer runs out, the broom position should be lowered by a set amount and the timer should be reset. In one embodiment, the timer may be set to 30 minutes for a first stage, 25 minutes for a second stage, and 20 minutes for a third stage. It should be understood that any time may be set by the broom controller or by the operator. For example, assume the broom wear is in a first stage with a 30 minute timer. Every 30 minutes, the broom may then be lowered by a set amount, and the timer may be reset. When the broom wear advances from the first stage to the second stage, a new timer value (e.g., 25 minutes) may be set.

Process 600 includes checking for a user input (step 614). If there is no user input, process 600 includes checking the interlocks (step 618) and determining if the interlocks are met (step 618). In an interlock mode of the truck, the broom is currently in use. If the broom is not in an interlock mode, it may mean that the broom is currently outside of the target range of the broom position (e.g., the broom is not in position for operation), the parking brake of the truck is on (e.g., the truck is not in operation), or the broom speed is less than a threshold (e.g., 10 RPM, indicating that broom usage is not substantial enough to cause broom wear). If the broom is not in an interlock mode, the timer is paused (step 620) as the broom is not in full or partial operation, and process 600 returns to checking for a user input.

If the broom is in interlock mode, the timer continues to run (step 622). Process 600 further includes checking if the pattern stage timer expired (step 624). If the timer did not expire, the timer may simply continue to run and process 600 returns to checking for a user input. When the timer expires, that indicates that a change in broom position is scheduled to occur. A counter is reset to zero (step 626). The counter may relate to a change in pattern from the operator and is discussed below.

When the timer expires, a new broom position target set point is set (step 642). The current broom position (stored by the broom controller and received from the position sensor) is retrieved, and a predetermined value (e.g., 1/16 inch, or another distance) may be added to the broom position target set point. The predetermined value is an offset applied to the current position. The predetermined value is a positive value indicating a downward movement of the broom position. This broom position target set point is saved in memory of the broom controller. Process 600 then returns to determine the broom wear stage (step 610).

In one embodiment, the target set point may include a range. The range may represent a target range for the broom position, such that the broom position will be considered in place if the actual broom position falls within the range. For example, if the range is set to ±0.012 inches, the broom position only has to be within 0.012 inches of the actual target set point to be considered in position.

If a user input is detected at step 614, process 600 includes determining if the user input relates to a request for a pattern change (step 628). The pattern change may relate to an increase or decrease in a desired broom pattern. If the user input does not relate to the broom pattern, the user input may be related to other broom 102 or truck 100 functionality, and process 600 may check the interlocks (step 616) and perform subsequent steps.

If a pattern change was requested, process 600 includes determining if the pattern adjustment is locked (step 630). A manager, supervisor, etc. may lock the operator of truck 100 from adjusting the broom pattern. The manager may lock the broom pattern to a desired setting before the operator being operating truck 100. If the pattern is locked by the manager, the operator input may be ignored and the broom pattern is not changed (step 632). Process 600 then returns to check the interlocks (step 616) and perform subsequent steps.

If the pattern change is allowed, process 600 includes checking a counter value against a limit (step 634). When the process is active, the operator may only be allowed to increase (or decrease) the pattern as often as allowed, based on pre-determined settings. This may prevent the operators from applying too much broom pattern (e.g., having a broom pattern too large) and wearing out the bristles of the broom too quickly. The counter may keep track of how many times the operator has requested the pattern to increase. If the counter reaches the limit, the request from the operator may be ignored and broom pattern is not changed (step 632). If the counter has not reached the limit, the pattern counter is increased (step 636) and a new target point is set for the broom based on the input (step 638). The new target set point may be adjusted by adding a predetermined value or a value specified by the operator. The value may be a negative value, indicating that the broom position is to be raised.

Process 600 further includes checking if the target set point is beyond a virtual limit (step 640). For example, if the broom core size is 46 inches, this step may include checking to see if the target set point is greater than 46 inches (or to an threshold value close to 46 inches). If so, process 600 indicate to the operator that the broom core needs to be replaced (step 644). If not, the broom position is adjusted based on the new target set point (step 632). The broom position target set point is transmitted to the hydraulic system, and the hydraulic system is turned on to lower the position of the broom core.

The limit may be adjustable based on varying user preferences. For example, the increment setting for the limit may be adjusted on a scale from 1 to 10, where 1 may indicate that the operator is rarely allowed to increase the broom pattern and 10 may allow the operator to increase the broom pattern more frequently.

Process 600 may allow for unlimited decreasing of the broom pattern (e.g., the broom pattern may be decreased as much as the operator likes). If the operator lifts the broom head from the ground (e.g., by lifting the broom head with the joystick), the limit counter may be reset and may allow the operator to start asking for a broom pattern increase, if the operator had used up all increases allowed already.

Various smart patterns may be used with process 600. In one embodiment, process 600 may be used with a three-stage setup, where the first stage includes 0% to 50% of broom wear, the second stage includes 50% to 80% of broom wear, and the third stage includes 80% to 100% of broom wear. The first stage, second stage, and third stage may have timers of 30 minutes, 25 minutes, and 20 minutes, respectively. In other embodiments, more or less stages may be included (including just one stage), and the timers may vary in length, either pre-set or defined by the operator.

Figure 7:
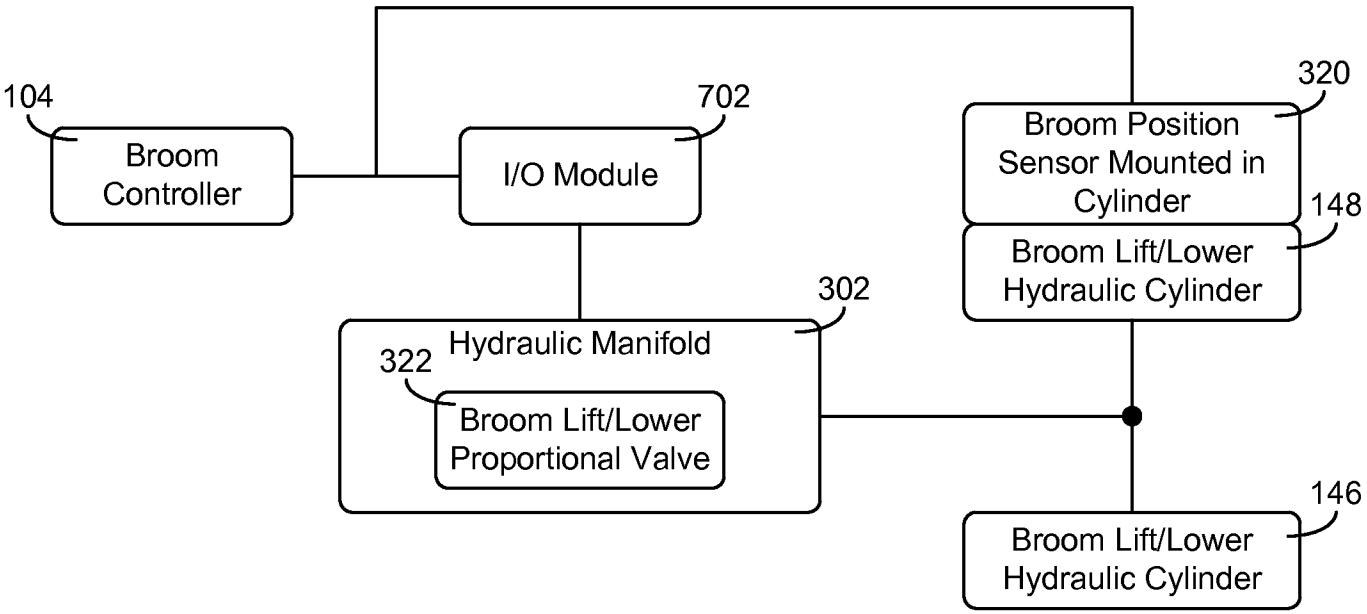
FIG. 7 is a block diagram of the system architecture including the broom controller of the snow removal truck, according to an exemplary embodiment.

Referring now to FIG. 7, a block diagram of the system architecture including the broom controller 104 of snow removal truck 100 is shown. The system architecture illustrates the interaction between broom controller 104 and various other modules of truck 100 configured to control broom operation. The system is shown to include two broom lift/lower hydraulic cylinders 146, 148 as described above, configured to raise or lower the broom position based on an input from hydraulic manifold 302. One of the hydraulic cylinders (148) includes broom position sensor 320 mounted in the cylinder as described above. In one embodiment, only one of the hydraulic cylinders may include the sensor; in another embodiment, both hydraulic cylinders may include the sensor, or the sensor may be located elsewhere. Position sensor 320 is shown connected to broom controller 104 and may be configured to provide sensor readings (e.g., broom position location) to broom controller 104.

Hydraulic manifold 302 may receive an input relating to broom position from broom controller 104 via an input/output (I/O) module 702. Hydraulic manifold 302 includes a broom lift/lower proportional valve 322 used to control the position of the hydraulic cylinders. I/O module 702 may be configured to receive input from broom controller 104 to provide to hydraulic manifold 302.

Figure 8:
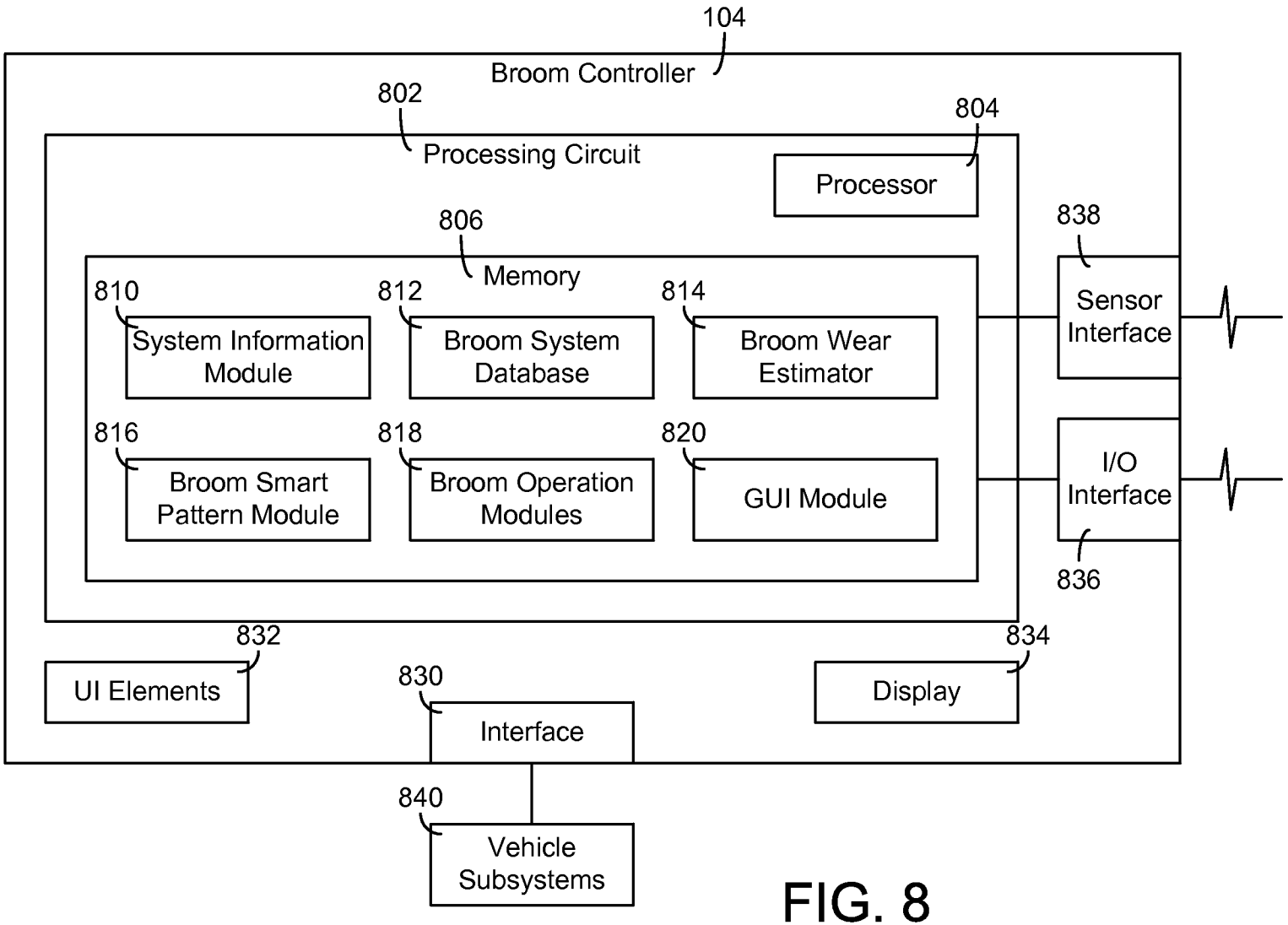
FIG. 8 is a block diagram of the broom controller of FIG. 7, according to an exemplary embodiment.

Referring to FIG. 8, broom controller 104 is shown in greater detail. Broom controller 104 is generally configured to provide a variable output for raising or lowering broom 102 as described herein. Broom controller 104 is shown to include a processing circuit 802 including a processor 804 and memory 806. Processor 804 may be implemented as a general purpose processor, an application specific integrated circuit (ASIC), one or more field programmable gate arrays (FPGAs), a group of processing components, or other suitable electronic processing components. Memory 806 is one or more devices (e.g., RAM, ROM, flash memory, hard disk storage, etc.) for storing data and/or computer code for completing and/or facilitating the various user or client processes, layers, and modules described in the present disclosure. Memory 806 may be or include volatile memory or non-volatile memory. Memory 806 may include database components, object code components, script components, or any other type of information structure for supporting the various activities and information structures of the present disclosure. Memory 806 is communicably connected to the processor 804 and includes computer code or instruction modules for executing one or more processes described herein.

The memory may include one or more modules configured to handle the activities described in the present disclosure (e.g., process 600). Memory 806 is shown to include a system information module 810. System information module 810 may include information related to vehicle and broom performance. For example, system information module 810 may receive data from various vehicle subsystems of truck 100 and determine a possible impact on broom performance. Broom controller 104 is shown to include an interface 830 connected with the other vehicle subsystems 840 of truck 100. Vehicle subsystems 840 may generally include the engine and system for controlling the engine, transmission, power systems, display systems, steering system, suspension, etc.

Memory 806 is further shown to include a broom system database 812. Broom system database 812 may be configured to store data related to broom operation. For example, broom system database 812 may store historical data (e.g., previous broom wear performance and broom performance). As another example, broom system database 812 may store operator information, such as a previous smart pattern used by the operator, an operator's desired smart pattern or settings, the type of changes the operator has made to a smart pattern in the past, etc. In one embodiment, the operator may save his or her settings related to the smart pattern, and the settings may be stored in broom system database 812.

In one embodiment, broom system database 812 may be configured to store a current status of a process of controlling the broom position. For example, during process 600 operation, the operator may wish to switch from the process to manual control of the broom. The operator may then control the broom and suspend process 600 operation, but broom system database 812 may be configured to store the last status (e.g., the last stage, last broom position, and last broom wear status). When the operator switches back from manual control to the control of process 600, the process may continue from where it left off, further accounting for broom wear during the manual use. As another example, broom system database 812 may store the current status of the process of controlling the broom position when the truck is turned off (so that the status is remembered by broom controller 104 when the truck is next used).

Memory 806 is further shown to include a broom wear estimator 814. Broom wear estimator 814 estimates the broom wear based on the broom rotation speed (e.g., the broom RPM), the type of bristles on broom 102, and outside conditions. Broom wear estimator 814 may further estimate the broom wear based on the current broom wear level of broom 102. For example, the broom wear rate may increase as the broom wear increases. The broom wear estimate may be used to determine an ideal timer value for each stage of the smart pattern, according to an exemplary embodiment.

Memory 806 is further shown to include a broom smart pattern module 816. Broom smart pattern module 816 may generally be configured to execute process 600 of FIG. 6, according to one embodiment. Broom smart pattern module 816 may set a smart pattern based on information from the operator and from the modules of memory 806. For example, broom smart pattern module 816 may receive a broom wear rate estimate from broom wear estimator 814 and determine a percentage threshold for each stage of the smart pattern, along with an ideal length of time between broom position shifts within each stage. Broom smart pattern module 816 may alter the smart pattern based on operator input (e.g., input provided via the user interface of FIG. 4D). Broom smart pattern module 816 may further receive information from system information module 810, broom system database 812, and broom operation modules 818 that may impact broom wear and broom performance, and may determine the appropriate adjustment to the smart pattern.

Memory 818 is further shown to include broom operation modules 818. Broom operation modules 818 may be configured to control the position of broom 102 based on the broom smart pattern determined by broom smart pattern module 816. Broom operation modules 818 may include a plurality of modules configured to control the position of the various hydraulic cylinders of broom assembly 110 and other settings related to broom 102 and truck 100.

Memory 806 is further shown to include a graphical user interface (GUI) module 820. GUI module 820 is configured to generate a GUI for an operator of the truck, such as the user interfaces shown in FIGS. 4B-E, and to receive and interpret the user input from the user interface. For example, GUI module 820 may receive a user input relating to a change in the broom pattern, and may provide the input to broom smart pattern module 816 for broom position adjustment. Broom controller 104 is further shown to include UI elements 832 and a display module 834 configured to generate the display for the user. UI elements 832 may allow the user to provide a user input via a touchscreen display, via a keyboard, a mouse or other pointer, via one or more buttons, knobs, or switches located on the user interface or elsewhere in truck 100, or otherwise. Display module 834 may be configured to provide a display as generally shown in FIGS. 4B-E.

Broom controller 104 further includes an I/O interface 838 configured to transmit and receive information from the various components of broom assembly 110. For example, I/O interface 838 may be connected to I/O module 702 as shown in FIG. 7. Broom controller 104 further includes a sensor interface 838 configured to receive data from the various sensors of truck 100. For example, sensor interface 838 may receive data from linear position sensor 320 as generally described in the present disclosure.

According to varying embodiments, sensor interface 838 may be connected to a pressure sensor. Broom assembly 110 or truck 100 may include one or more pressure sensors. Using readings from the pressure sensors, broom controller 104 may estimate the size of the broom pattern, the amount of wear, and/or the stage of wear. According to an exemplary embodiment, the pressure sensor senses a load on hydraulic drive motor 124 of broom assembly 110 (e.g., with a load sensing line, based on the pressure applied to the hydraulic drive motor, etc.). In another embodiment, the pressure sensor senses a contact pressure between broom 102 and the ground surface). In still other embodiments, the pressure sensor may sense a fluid pressure (e.g., hydraulic fluid pressure) associated with the life actuators. Broom controller 104 may be configured to receive the pressure and determine a broom pattern size based on the pressure (e.g., a pressure of 2000 psi may correspond with a 2 to 4 inch broom pattern, or another broom pattern). In such embodiments, the pressure sensor can be used either in place of the positioning sensor described above or to complement the positioning sensor. For example, the pressure sensor may be used to initially find a target position setpoint. Such a target position setpoint may be determined, by way of example, while truck 100 is stationary to limit fluctuations in pressure due to movement and ground clutter.

A pressure sensor may be located within a hydraulic broom lift cylinder 146, 148 and measure a pressure difference between (a) a free-hanging or raised broom position and (b) a lowered position where broom 102 is being pressed against the ground. In other embodiments, the sensor may relay the pressure of the fluid within the broom lift cylinder 146, 148 and broom controller 104 may determine a sweeping pressure using the pressure reading provided by the pressure sensor and the value of a parameter (e.g., the pressure reading for a free-hanging broom, the pressure reading for broom having unused bristles, the pressure reading for a broom having spent bristles, etc.). The correlation between the pressure sensor data and broom pattern and/or broom position or lift position may be made using data from system information module 810 and broom system database 812.

In one embodiment, the pressure sensor data may be used to set an initial broom pattern. Referring also to process 600, the operator may set an initial desired broom pattern. Instead of the operator manually moving broom 102 into place, the pressure sensor data may be used to set the broom position. For example, broom 102 may be lowered until a hydraulic pressure is detected that corresponds with a particular broom position or broom pattern. A particular broom position or broom pattern for a pressure reading may be stored as a table within memory 806, calculated using an algorithm, or otherwise determined. Data for the particular broom position or broom pattern may be stored for use onboard truck 100.

In one embodiment, the pressure sensor data may be used in concert with broom wear rate information and timer information to determine when to adjust a position of broom 102. For example, process 600 may additionally include a step of checking the pressure sensor of hydraulic cylinder 146, 148 and/or broom 102. If the pressure is lower than a threshold value (e.g., when broom 102 has worn out enough such that the pressure between broom 102 and the ground has decreased), process 600 may then determine that the broom position should be lowered in response to the broom wear, and/or process 600 may determine to move to a next stage of the smart pattern. The pressure sensor data may further be compared to the broom wear rate to determine if the broom wear rate is accurate, if there has been a change in condition or operation of truck 100, or otherwise. For example, if broom 102 is wearing out at a greater rate than expected, the pressure sensor data may be used to detect the decrease in pressure that results, may indicate to the operator that the broom wear rate is higher than expected, and may revise the smart pattern accordingly. In some embodiments, the pressure sensor data is used to determine when the broom wear has reached a maximum designed level. The controller may turn off the rotational motors or may elevate broom 102 upon sensing that the broom wear has reached a maximum designed level.

In one embodiment, the pressure sensor data may be used in place of the broom wear rate. For example, process 600 may continue to operate in a first stage until a pressure decreases below a set point. Process 600 may then move on to a second stage, without considering the broom wear.

In one embodiment, the operator may identify a desired setting based on the pressure. For example, the operator may choose between two or more different modes (e.g., heavy, medium, light, etc.) that correspond to a desired pressure level between broom 102 and the ground, or between broom 102 and hydraulic cylinders 146, 148. The operator may indicate the preference via a user interface (e.g., additional buttons on the user interface of FIGS. 4B-E). Broom controller 104 may then be configured to determine a broom position throughout the smart pattern cycle that maintains the appropriate pressure.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data, which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A broom assembly for a vehicle, comprising:

a frame;

a broom core axle rotatably coupled to the frame, wherein the broom core axle defines an axis around which a broom rotates when in use;

an actuator coupled to the frame and positioned to raise and lower the broom core axle relative to the frame; and a controller having an output for adjusting the actuator and an input for receiving information from a sensor, wherein the controller is configured to:

use the received information to automatically lower the broom core axle over a period of operation to account for an estimated wear of the broom;

use the sensor input to controllably adjust the actuator to a position setpoint changing over the period of operation to account for the estimated wear;

use, after the period of operation, the sensor input to determine a current position and to add an offset to the current position to achieve a new sensor target setpoint; and use the new sensor target setpoint to adjust the output.

2. The broom assembly of claim 1, wherein the information received comprises position information.

3. The broom assembly of claim 2, wherein the sensor comprises a linear position sensor.

4. The broom assembly of claim 1, wherein the controller is configured to use the sensor input to determine a broom wear percentage.

5. The broom assembly of claim 1, wherein the period of operation is determined based on an estimated stage of wear for the broom.

6. The broom assembly of claim 5, wherein the controller includes a memory, and wherein the controller is configured to determine whether the broom is estimated to be in a first stage of wear or a second stage of wear using the memory, and wherein the period of operation is longer in the first stage of wear and shorter in the second stage of wear.

7. The broom assembly of claim 6, wherein the controller is configured to use the sensor input to determine the estimated stage of wear.

8. The broom assembly of claim 7, wherein the controller refrains from lowering the broom more than a predetermined number of times during the period of operation.

9. The broom assembly of claim 7, wherein the controller is configured to receive a user input from a user input device, the user input comprising a command to lower the broom, and wherein the controller adds a user offset to the current position to achieve a user adjusted position sensor target setpoint.

10. The broom assembly of claim 9, wherein the stage of broom wear is estimated after each movement of the broom caused by the user input and wherein a timer for tracking the period of operation is reset after the movement.

11. The broom assembly of claim 10, wherein the controller does not use feedback directly relating to broom wear to calculate the offset.

12. A vehicle, comprising:

an engine coupled to a chassis;

a broom assembly, comprising:

a frame;

a broom core axle rotatably coupled to the frame, wherein the broom core axle defines an axis around which a broom rotates when in use; and an actuator coupled to the frame and positioned to raise and lower the broom core axle relative to the frame; and a controller having a variable output for adjusting the actuator and an input for receiving information from a sensor, wherein the controller is configured to:

use the received information to automatically lower the broom core axle over a period of operation to achieve a target amount of brush contact with the ground;

use, after the period of operation, the sensor input to determine a current position and to add an offset to the current position to achieve a new sensor target setpoint; and use the new sensor target setpoint to adjust the variable output, wherein the controller does not use feedback directly relating to broom wear.

13. The vehicle of claim 12, wherein the information received comprises position information.

14. The vehicle of claim 13, wherein the sensor comprises a linear position sensor.

15. The vehicle of claim 12, further comprising a hydraulic system, the hydraulic system including an electronically adjustable valve, wherein the variable output is output for the electronically adjustable valve to selectively engage the actuator.

* * * * *